US007951056B2

(12) United States Patent
Radzwill

(10) Patent No.: US 7,951,056 B2
(45) Date of Patent: May 31, 2011

(54) ROCKABLE EXERCISE APPARATUS

(76) Inventor: Eric Radzwill, Fort Lauderdale, FL (US)

( * ) Notice: Subject to any disclaimer, the term of this patent is extended or adjusted under 35 U.S.C. 154(b) by 0 days.

(21) Appl. No.: 12/607,875

(22) Filed: Oct. 28, 2009

(65) Prior Publication Data

US 2011/0098163 A1 Apr. 28, 2011

(51) Int. Cl.
*A63B 26/00* (2006.01)

(52) U.S. Cl. ..... 482/142

(58) Field of Classification Search ..... 482/142, 482/140, 148, 139, 121–130, 92–96, 51, 482/907

See application file for complete search history.

(56) References Cited

U.S. PATENT DOCUMENTS

| | | | | | |
|---|---|---|---|---|---|
| 228,845 | A | * | 6/1880 | Walthour | 482/72 |
| 1,815,183 | A | * | 7/1931 | Brown et al. | 446/326 |
| 1,911,572 | A | * | 5/1933 | Hulander et al. | 482/142 |
| 1,979,716 | A | * | 11/1934 | Terry | 482/72 |
| D168,270 | S | * | 11/1952 | Lamb | D6/348 |
| 2,768,828 | A | * | 10/1956 | Pack | 482/35 |
| 3,183,035 | A | * | 5/1965 | Ross | 297/281 |
| 3,475,020 | A | * | 10/1969 | Schauerte | 482/146 |
| 3,544,103 | A | * | 12/1970 | Conable | 482/130 |
| 4,241,949 | A | * | 12/1980 | Parker | 297/3 |
| 4,403,773 | A | * | 9/1983 | Swann | 482/130 |
| D279,239 | S | * | 6/1985 | Meier | D6/361 |
| D286,802 | S | * | 11/1986 | Ahlberg | D21/688 |
| 4,674,740 | A | * | 6/1987 | Iams et al. | 482/56 |
| 4,684,126 | A | * | 8/1987 | Dalebout et al. | 482/138 |
| 4,746,112 | A | * | 5/1988 | Fayal | 482/73 |
| 4,752,067 | A | * | 6/1988 | Colonello | 482/140 |
| 4,759,542 | A | * | 7/1988 | Hudec | 482/34 |
| 4,848,742 | A | * | 7/1989 | Lindley et al. | 482/142 |
| 4,861,025 | A | * | 8/1989 | Rockwell | 482/142 |
| 4,919,481 | A | * | 4/1990 | Garabedian | 297/271.6 |
| 4,946,160 | A | * | 8/1990 | Bertoletti | 482/71 |
| D323,434 | S | * | 1/1992 | Moynihan et al. | D6/368 |
| 5,213,394 | A | * | 5/1993 | Tattrie | 297/258.1 |
| D340,813 | S | * | 11/1993 | Liu | D6/348 |
| 5,496,246 | A | * | 3/1996 | Pierre | 482/130 |
| 5,531,658 | A | * | 7/1996 | Liao | 482/142 |
| 5,582,567 | A | * | 12/1996 | Chang | 482/146 |
| 5,702,333 | A | * | 12/1997 | Waldron et al. | 482/131 |
| 5,733,233 | A | * | 3/1998 | Webber | 482/137 |
| 5,906,566 | A | * | 5/1999 | Whitcomb | 482/130 |
| 6,244,995 | B1 | * | 6/2001 | Prsala | 482/96 |
| 6,258,016 | B1 | * | 7/2001 | Kuo | 482/142 |
| 6,450,578 | B1 | * | 9/2002 | Taggett | 297/325 |
| D490,868 | S | * | 6/2004 | Tornabene | D21/690 |
| 6,971,977 | B1 | * | 12/2005 | Chen | 482/140 |
| 7,150,702 | B2 | * | 12/2006 | Webb et al. | 482/130 |
| 7,270,628 | B2 | * | 9/2007 | Campanaro et al. | 482/95 |

(Continued)

FOREIGN PATENT DOCUMENTS

GB 2278538 A 12/1994

*Primary Examiner* — Lori Baker

(74) *Attorney, Agent, or Firm* — The Concept Law Group, P.A.; Scott D. Smiley

(57) ABSTRACT

An exercise device includes a substantially planar upper surface having a first extent and a second extent and a support structure that supports and spaces the upper surface from the floor. The support structure has a curve with a vertex located between the first extent and the second extent and a support-structure extent that extends beyond the second upper-surface extent in a direction away from the first upper-surface extent.

18 Claims, 13 Drawing Sheets

U.S. PATENT DOCUMENTS

| | | | | |
|---|---|---|---|---|
| 7,276,033 | B2 * | 10/2007 | Phillips | 601/23 |
| D565,852 | S * | 4/2008 | Wang | D6/361 |
| D582,494 | S * | 12/2008 | Elnekaveh | D21/687 |
| 7,488,278 | B2 * | 2/2009 | Zhang | 482/123 |
| 7,537,555 | B2 * | 5/2009 | Soletski | 482/142 |
| 7,553,261 | B2 * | 6/2009 | Carbone | 482/72 |
| 7,575,277 | B2 * | 8/2009 | Habing | 297/270.5 |
| 2002/0022558 | A1 * | 2/2002 | Casey | 482/95 |
| 2003/0064868 | A1 * | 4/2003 | Ish et al. | 482/99 |
| 2004/0067830 | A1 * | 4/2004 | Rovere et al. | 482/140 |
| 2005/0159276 | A1 * | 7/2005 | Falcone | 482/123 |
| 2005/0181916 | A1 * | 8/2005 | Frost et al. | 482/140 |
| 2007/0111869 | A1 * | 5/2007 | Wallach | 482/129 |
| 2007/0149372 | A1 | 6/2007 | Zhang | |
| 2008/0108487 | A1 * | 5/2008 | Bizzell et al. | 482/142 |
| 2010/0087301 | A1 * | 4/2010 | Juncker | 482/146 |
| 2010/0099542 | A1 * | 4/2010 | Fernandez et al. | 482/142 |

* cited by examiner

ROCKABLE EXERCISE APPARATUS

FIELD OF THE INVENTION

The present invention relates generally to an exercise apparatus, and more particularly relates to an exercise apparatus with a curved bottom surface that provides instantly selectable workout resistances.

BACKGROUND OF THE INVENTION

Much research has been performed on exercise, its various techniques, frequencies, intensities thereof, and the corresponding benefits to the human body. This research has concluded that exercise is an undeniably valuable endeavor for the vast majority of the population. In fact, every day, millions of Americans participate in some sort of physical activity solely for the health benefits they receive from such an activity. For others, exercise comes as a happy side effect of normal activities they perform.

One of the most popular forms of exercise is commonly referred to as "working out," which is a type of training for developing the strength and size of skeletal muscles. When one works out, they typically use the force of gravity by performing movements that oppose gravity. For instance, lifting weights is a direct opposition to the force of gravity being naturally placed on the weights and the result is an opposing resistance placed onto the muscles that are being used to perform the lifting activity. Similarly, pushing one's body (a weight) against the force of gravity places that resistance directly onto the muscles opposing the force. As an example, push-ups, one of the seven primary callisthenic exercises, is a common strength training exercise performed in a prone position, lying horizontal and face down, and using the arms to raise and lower the body. The contact of the person's toes with the ground forms the pivot of this exercise. Push-ups develop the pectoral muscles and triceps, with ancillary benefits to the deltoids, serratus anterior, coracobrachialis, and the midsection as a whole.

A way of making push-ups less difficult is referred to as a knee push-up. Instead of using the toes as the pivot contact point with the ground, the person places his/her knees on the floor and pivots the body at the knees. For some, this variation still requires too much effort and, as a result, those individuals avoid or fail to perform push-ups altogether. For others, a compromise between the more difficult standard push-ups and the easier knee push-ups is desired.

Over the years, a variety of specialized equipment has been developed to target specific muscle groups and types of movement. Several devices have attempted to target the same pectoral muscles used to perform push-ups. However, each of these devices requires multiple device parts, such as a bench and separate weights, bars, etc. The devices also include heavy apparatuses that are difficult to move and install, and those with variable weights bear a considerable expense.

Therefore, a need exists to overcome the problems with the prior art as discussed above.

SUMMARY OF THE INVENTION

Briefly, in accordance with the present invention, disclosed is an exercise device that includes a substantially planar upper surface having a first end and a second end and a support structure that supports and spaces the upper surface from the floor. The support structure has a curve with a vertex located between the first end and the second end and a support-structure end that extends beyond the second upper-surface end in a direction away from the first upper-surface end.

In accordance with a further feature of the present invention, the upper surface includes a first portion that including the first end and a second portion that includes the second end, where the second portion is pivotally coupled to the first portion at a pivot point.

In accordance with yet another feature of the present invention, a support bar has a first end rotatably attached to the support structure and a second end attachable to any of a plurality of locations along a back side of the second portion of the upper surface, thereby providing a plurality of second portion elevation angles.

In accordance with an additional feature of the present invention, the vertex is located between a first plane and a second plane, the first plane passing through the first end of the upper surface, the second plane passing through the pivot point, and the first and second planes being parallel to each other and perpendicular to the first portion of the upper surface.

In accordance with yet another feature of the present invention, the support structure curve and end together form a general "S" shape when viewed from a side thereof.

In accordance with another feature, an embodiment of the present invention includes a first arm having a first end and a second end and is coupled to a first side of the support structure at the first end thereof. A second arm has a first end and a second end and is coupled to a second side of the support structure at the first end thereof. A resistance device is physically coupled to the support structure, a first cable is physically coupled to the resistance device and slidably engaged at the second end of the first arm and a second cable is physically coupled to the resistance device and slidably engaged at the second end of the second arm.

In accordance with yet another feature, an embodiment of the present invention includes a first pivot point at a junction between the first end of the first arm and the first side of the support structure and a second pivot point at a junction between the first end of the second arm and the second side of the support structure.

In accordance with a further feature, the present invention includes a first pulley at the first pivot point and a second pulley at the second pivot point, wherein the first pulley rotationally engages the first cable and the second pulley rotationally engages the second cable.

In accordance with another feature of the present invention the resistance device provides a selectable tension strength.

In accordance with one more feature, the present invention includes a leg-securing structure at the first end of the upper surface, the leg-securing structure having a first end and a second end opposite the first end, the first and second ends being collinear and extending in a plane parallel to a plane of the first upper surface. The leg-securing structure can include a detachable support coupled to the first end of the upper surface and extends in a direction substantially perpendicular to the first upper surface. The leg-securing structure can also include an ankle-securing structure coupled to the support, the ankle-securing structure having a first end and a second end opposite the first end, the first and second ends being collinear and extending in a plane parallel to a plane of the first upper surface.

Although the invention is illustrated and described herein as embodied in a rockable exercise apparatus, it is, nevertheless, not intended to be limited to the details shown because various modifications and structural changes may be made therein without departing from the spirit of the invention and within the scope and range of equivalents of the claims.

Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention.

BRIEF DESCRIPTION OF THE DRAWINGS

The accompanying figures, where like reference numerals refer to identical or functionally similar elements throughout the separate views and which, together with the detailed description below, are incorporated in and form part of the specification, serve to further illustrate various embodiments and to explain various principles and advantages all in accordance with the present invention.

DETAILED DESCRIPTION

Figure 1:
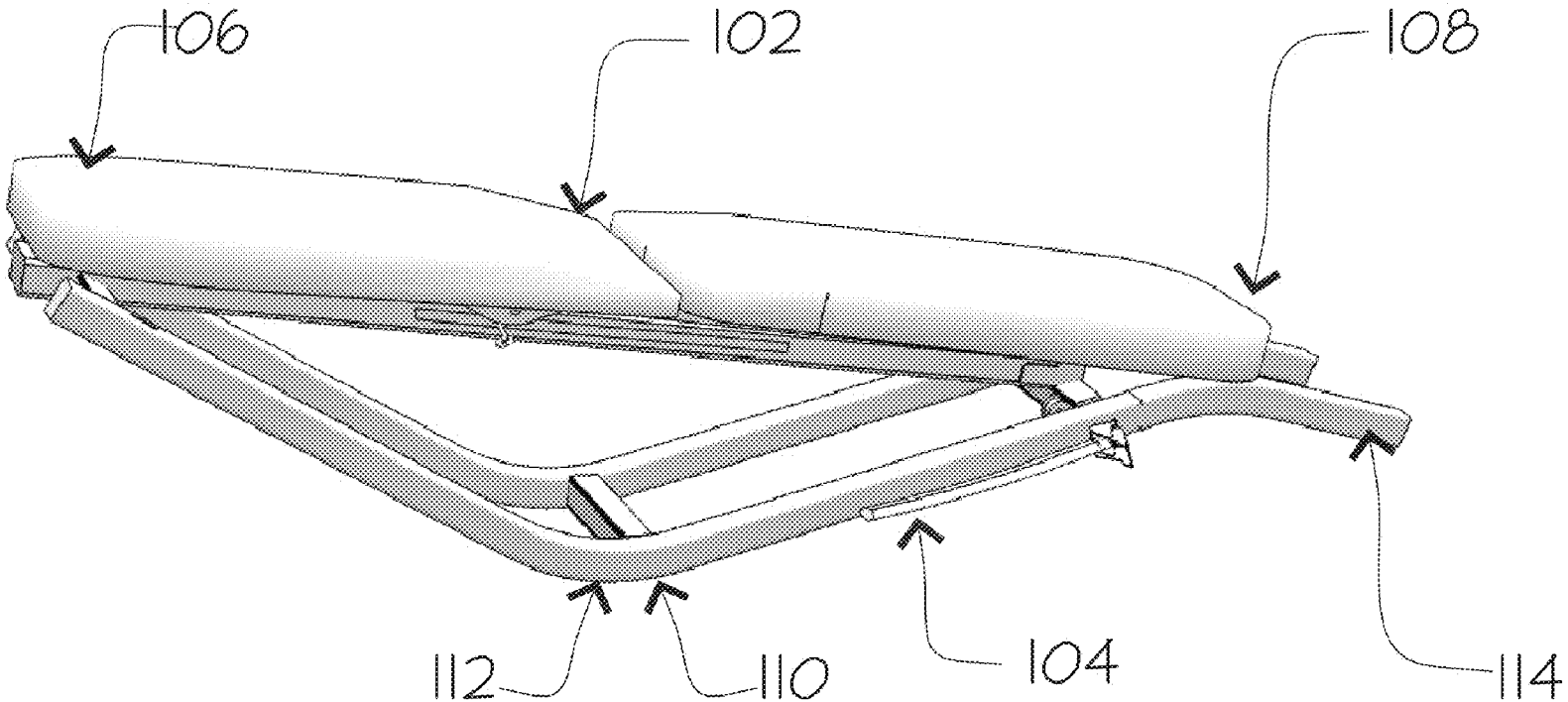
FIG. 1 is a perspective view of a rockable exercise apparatus in accordance with the present invention.

While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

It is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting, but rather, to provide an understandable description of the invention.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. As used herein, the term "about" or "approximately" applies to all numeric values, whether or not explicitly indicated. These terms generally refer to a range of numbers that one of skill in the art would consider equivalent to the recited values (i.e., having the same function or result).

The present invention provides a novel rockable exercise apparatus that allows instant adjustment to resistive loads without the need for provision of or movement of device components. The invention can be provided in many embodiments, allowing complexity to span from a unitary device with no moving parts to a complex assembly with adjustable features that provide a plurality of exercises and exercise settings.

Referring now to FIG. 1, one embodiment of the present invention is shown. FIG. 1 illustrates several advantageous features of the present invention, but, as will be described below, the invention can be provided in several shapes, sizes, combinations of features and components, and varying numbers and functions of the components. In this first embodiment of FIG. 1, the presently inventive exercise bench 100 features a substantially planar upper surface 102 that is supported off of the ground by a support structure 104. The upper surface has a first end 106 and a second end 108, opposite the first end 106.

Figure 2:
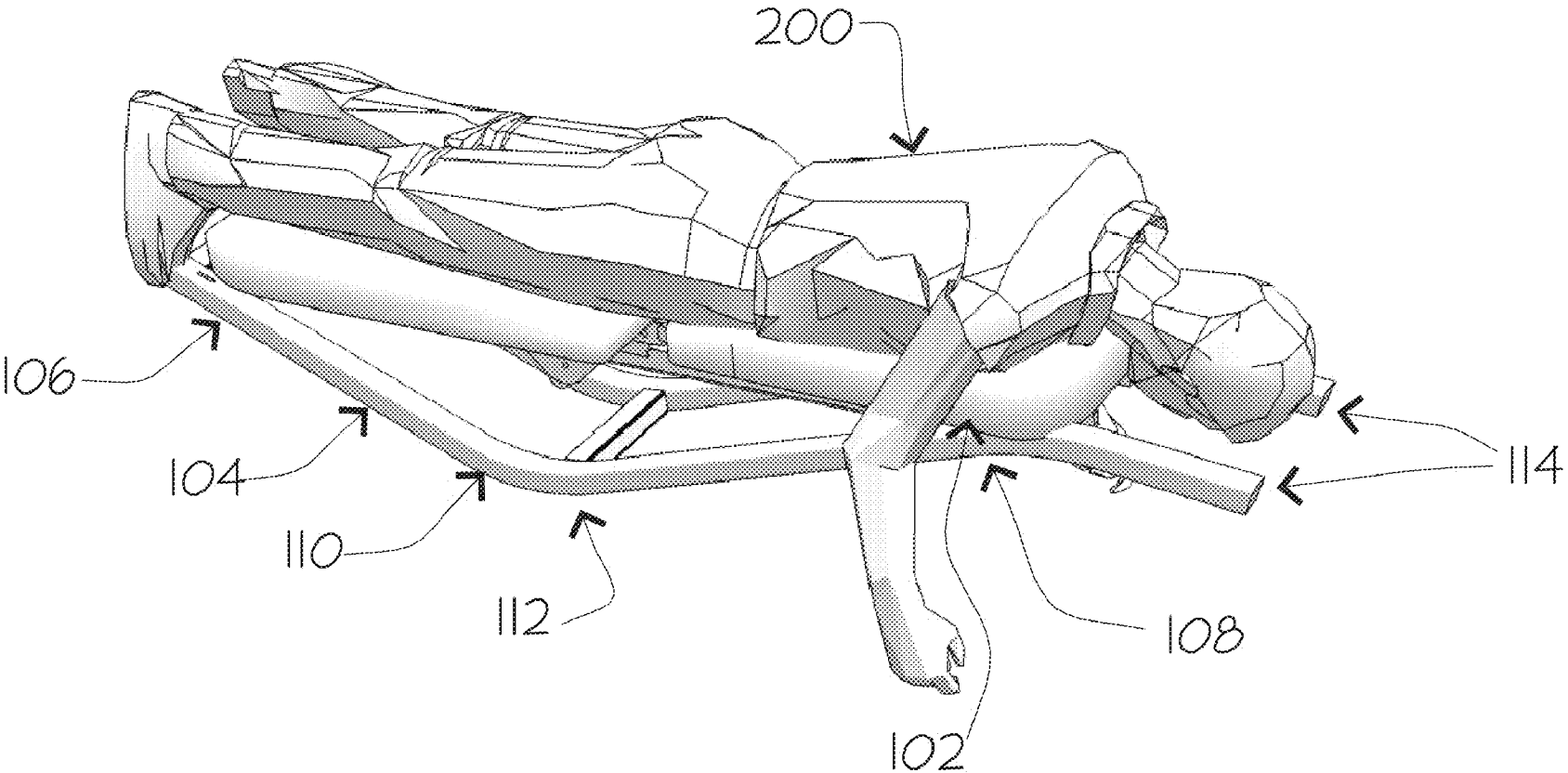
FIG. 2 is a perspective view of a user positioned face down on top of the rockable exercise apparatus of FIG. 1.

Although the upper surface 102 is described herein as being substantially "planar," that term, as used herein, is not intended to indicate an entire lack of curvature or surface features. For example, in at least one embodiment, the upper surface 102 is padded for comfort and has a slight curvature in all directions from a centerline extending along the upper surface 102. Comfort is advantageous because one use of the device, as shown in FIG. 2, is with a user 200 laying face down on the upper surface 102. Therefore, a general definition of the term "substantially planar" is a general flat surface suitable for a human to lie face down thereon, as shown in FIG. 2.

Figure 3:
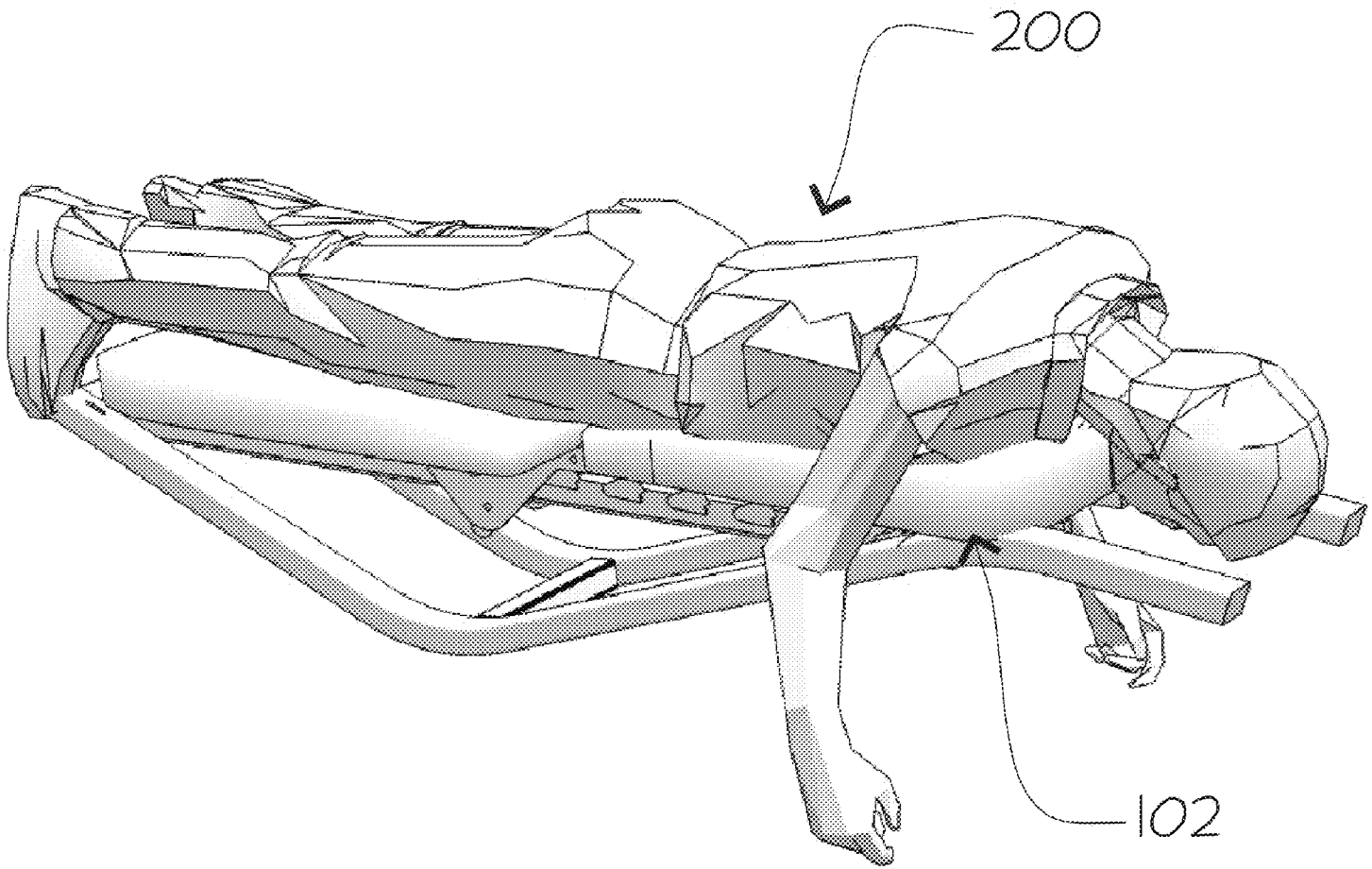
FIG. 3 is a perspective view of a user positioned on top of and rocking the rockable exercise apparatus of FIG. 1 to a horizontal position.

In both FIG. 1 and FIG. 2, it can be seen that the lower support structure 104 has as curved shape 110. The curved shape 110 has a vertex 112 located between the first end 106 and the second end 108. The vertex 112 is a maximum extent of the curved shape 110 and advantageously allows the device 100, as shown in FIG. 3, to rock or pivot between the angled position of FIG. 1 to the horizontal position of FIG. 3. The vertex/pivot point 112, similar to performing push-ups on one's knees, moves the fulcrum away from the user's feet and, as a result, reduces the amount of force necessary to push one's upper body away from the ground. By sliding the user's chest further away from the vertex 112, performing a push up becomes more difficult. Conversely, by moving the user's chest closer to the vertex 112, performing a push up becomes easier. For this reason, the present invention advantageously provides instantly-selectable workout resistances without any need for adjusting the device or utilizing additional features, devices, or equipment.

Referring once again back to FIG. 1, a support-structure end 114 can be seen extending beyond the second upper-surface end 108 in a direction away from the first upper-surface end 106. The support-structure end 114 provides a second contact point with the floor, the vertex 112 being the first, and provides stability to the device 100. Having the support-structure end 114 extending beyond the upper surface 102, as can be seen in FIG. 2, is advantageous, as it prevents the user's face from contacting the floor. In other embodiments and uses of the device 100, the support-structure end 114 acts as stabilizing legs.

Figure 4:
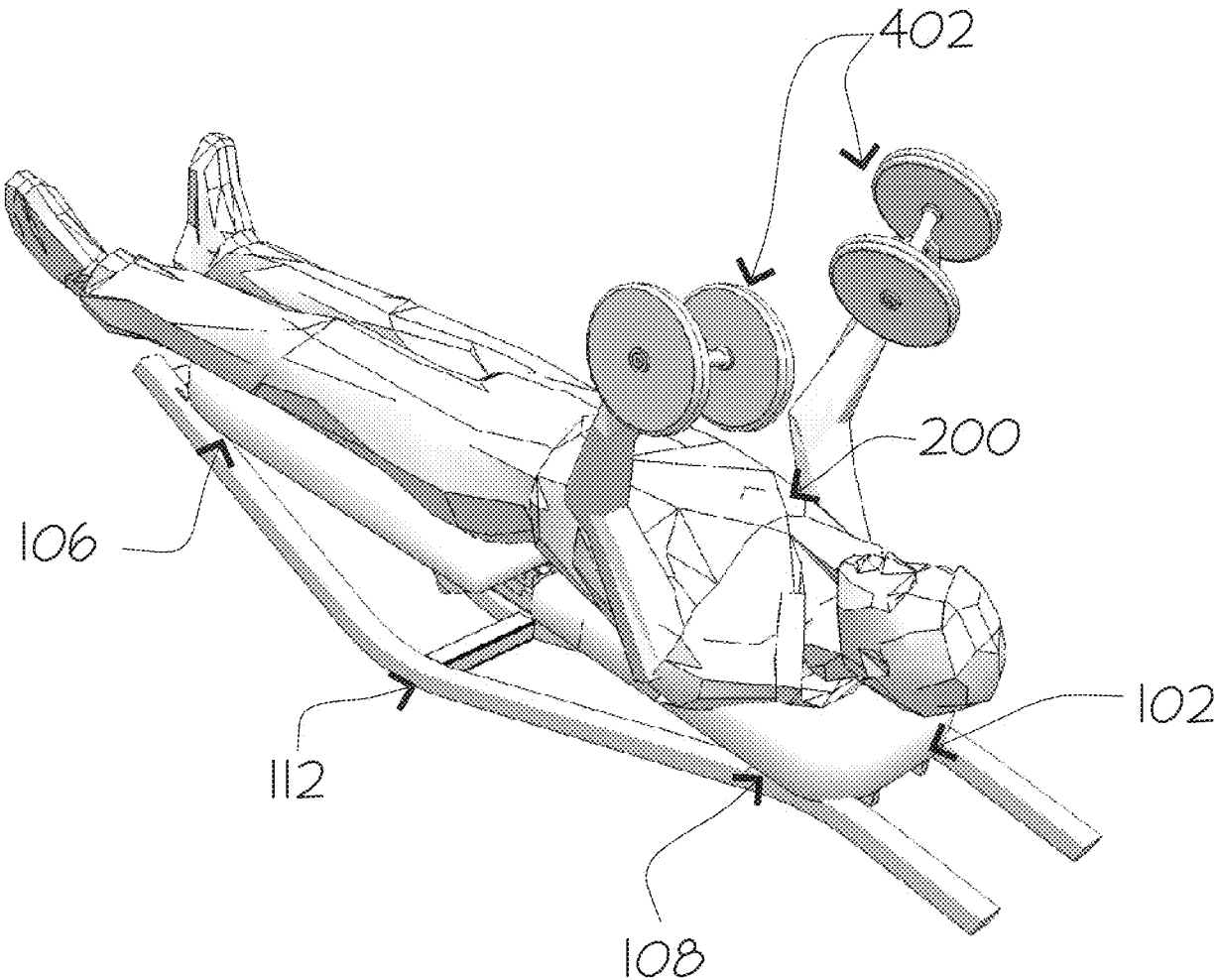
FIG. 4 is a perspective view of a user positioned face up on top of the rockable exercise apparatus of FIG. 1.

Referring now to FIG. 4, other utilities of the inventive device are shown. In this exemplary alternative use, the user 200 lies on the upper surface 102 in a face-up position. From this position, the user 200 can utilize weights 402 to perform a large variety of exercises. Because more weight is placed on the upper surface 102 between the vertex 112 and the second upper-surface end 108 than is placed between the vertex 112 and the first upper-surface end 106, the device 100 is completely stabilized by the support-structure end 114 and does not pivot.

Figure 5:
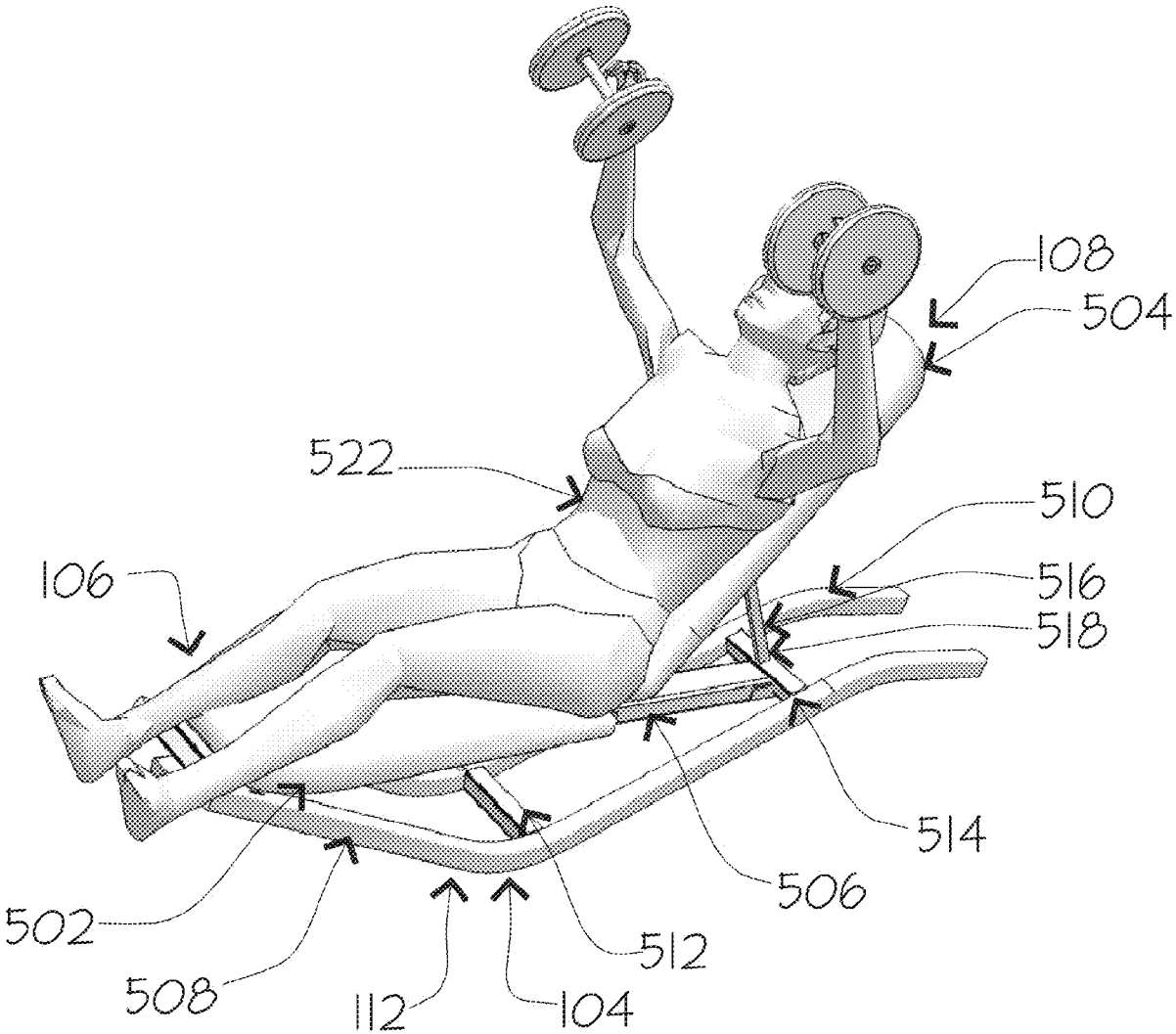
FIG. 5 is a perspective view of a user positioned in a sitting position on top of the rockable exercise apparatus of FIG. 1 with a portion of the upper surface secured in an elevated position.

FIG. 5 shows an additional embodiment of the exercise device 100. In this embodiment, the upper surface 102 is divided into two portions 502, 504. The first portion 502 includes the first upper-surface end 106. The second portion 504 of the upper surface 102 includes the second upper-surface end 108. The first portion 502 and second portion 504 are pivotally coupled to each other at a pivot point 506.

The particular support structure 104, depicted in the figures of the instant application, includes a pair of similarly-shaped adjacent bars 508, 510 that are coupled to each other at the vertex 112 by an element 512 and one or more additional spacing bars 514. A support bar 516 has a first end 518 rotatably attached to the support structure 104 at one of the spacing bars 514 and a second end 520 (not shown in this view) attachable to any of a plurality of locations along a back side of the second portion 504 of the upper surface 102, thereby providing a plurality of supported elevation angles for the second portion 504 of the upper surface 102. FIG. 5 shows a user 522 whose lower body is supported by the first portion 502 of the upper surface 102 and whose upper body is supported by the second portion 504 of the upper surface 102, which is held at an angle to the first portion 502 of the upper surface 102 by the support bar 516. This feature of the present invention provides a large range of possible exercises that can be performed with the inventive device 500. The depiction of the user 522 lifting barbells in what is referred to as an "incline press," is just one example and many others are possible.

Figure 6:
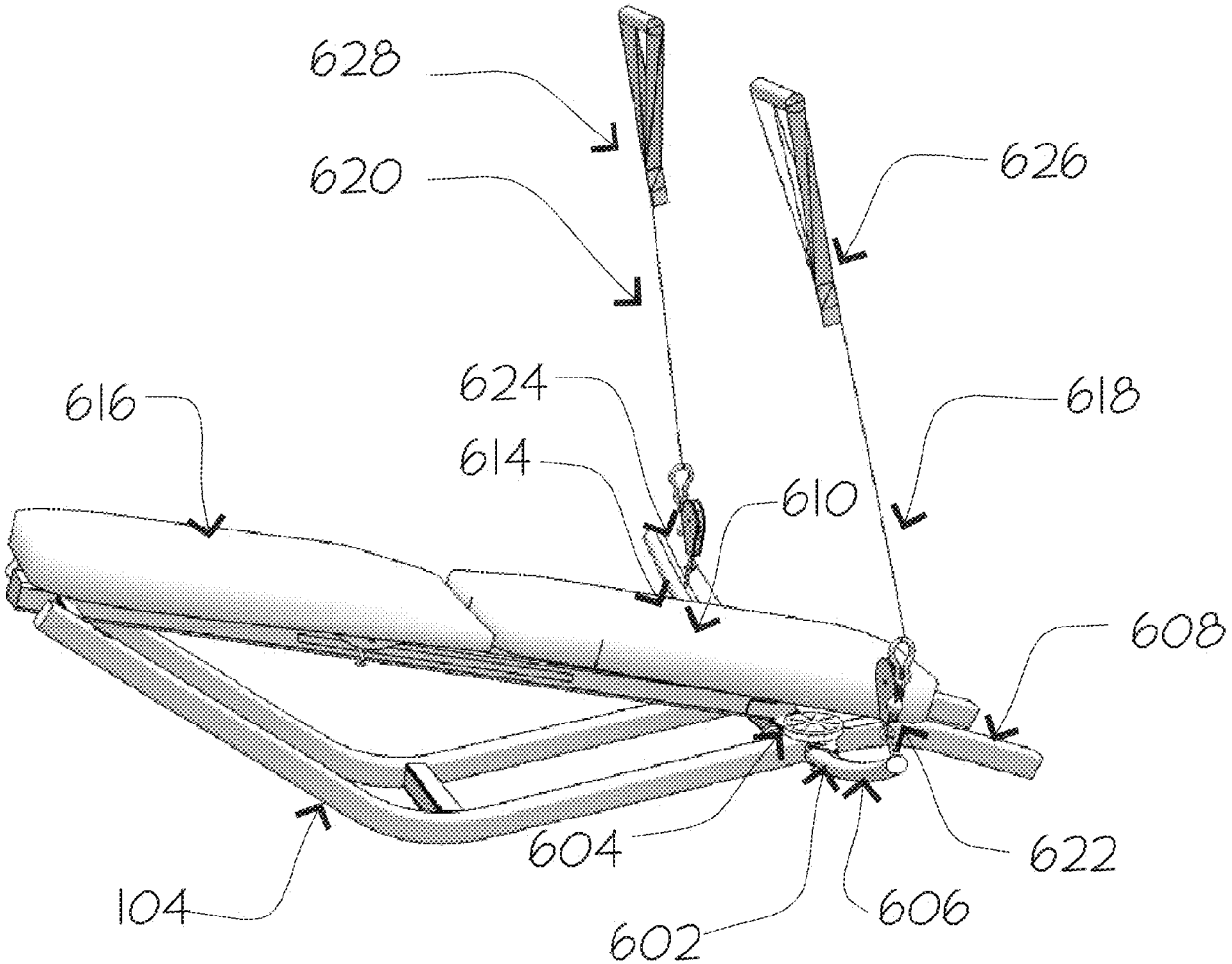
FIG. 6 is a perspective view of a rockable exercise apparatus with arm and handle features in accordance with an exemplary embodiment of the present invention.

FIG. 6 shows an additional feature that can be provided with the present invention. In this embodiment, a first arm 602 with a first end 604 and a second end 606 is coupled to a first side 608 of the support structure 104. A second arm 610, shown best in FIG. 7, with a first end 612 and a second end 614, is coupled to an opposing second side 616 of the support structure 104. The arms 602 and 610 operate in conjunction with, as shown in FIGS. 8 and 9, a resistance device 800 that is physically coupled to the support structure 104 of the device 600.

Figure 8:
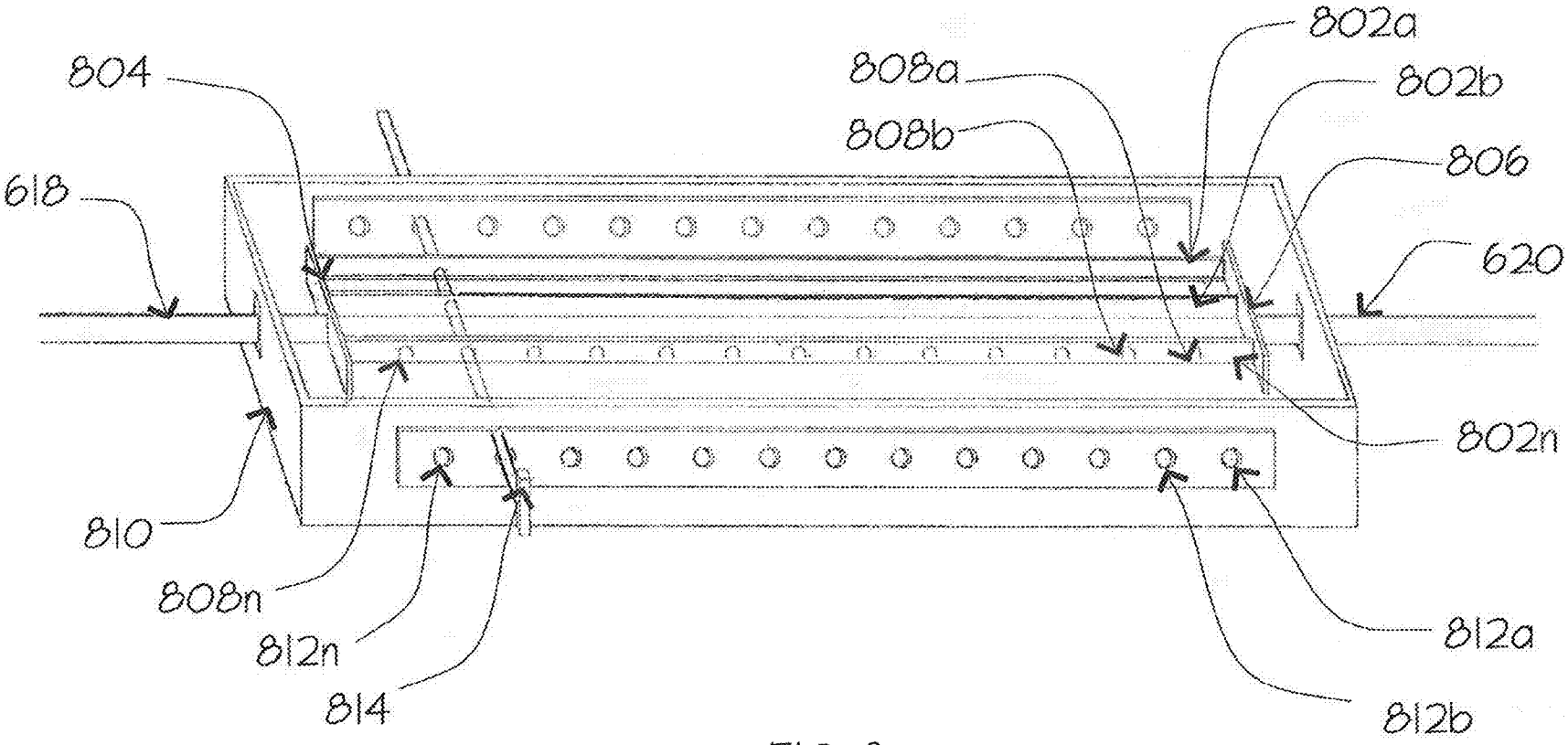
FIG. 8 is a fragmentary, perspective view of a resistance device in accordance with the present invention.
Figure 9:
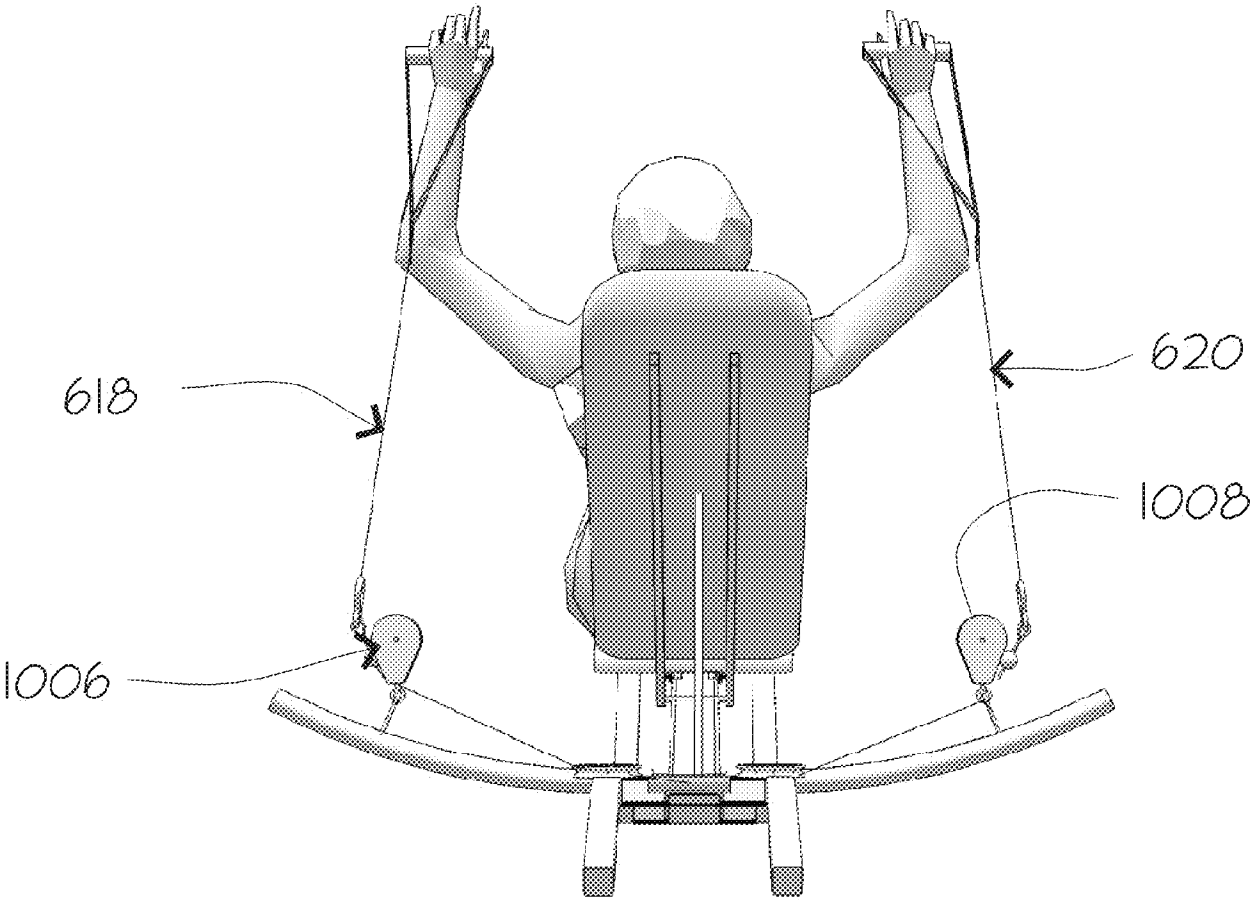
FIG. 9 is a perspective view of the rockable exercise apparatus of FIG. 7 from the rear.

Referring first to FIG. 8, the resistance device 800, according to one embodiment, includes one or more elastic bands 802*a-n*, each having a predetermined tension force/resistance. One or more cable-securing anchors 804, 806 (two shown in this embodiment) provide an attachment location for a set of cables 618, 620 to attach to the elastic bands 802*a-n*. By adjusting the number of elastic bands being stretched, the corresponding resistive force applied to the cables can also be adjusted. Specifically, the more bands 802*a-n*, the higher the resistance applied to the cables. In addition, by dictating how much of a particular one or more of the elastic bands 802*a-n* is stretched, the resistive force can be increased or decreased. Therefore, as shown in FIG. 8, the elastic bands 802*a-n* are provided with a set of holes 808*a-n* and a box 810, partially enclosing the elastic bands 802*a-n*, is also provided with a set of holes 812*a-n* that correspond to the set of holes 808*a-n* in the elastic bands 802*a-n*. One or more tension-adjusting rods 814 can then be used to secure the elastic bands 802*a-n* and prevent a portion of them from being stretched when the cable-securing anchors 804, 806 are pulled in opposing directions.

Referring back to FIG. 6, it can be seen that a first cable 618 is slidably engaged at the second end 606 of the first arm 602 by a ring 622. The cable 618 runs the length of the first arm 602, passes into a central area of the device 600 and is physically coupled to the resistance device 800 (not shown in the view of FIG. 6). Similarly, a second cable 620 is physically coupled to the resistance device 800 and is slidably engaged with a second ring 624 at the second end 614 of the second arm 610.

Figure 10:
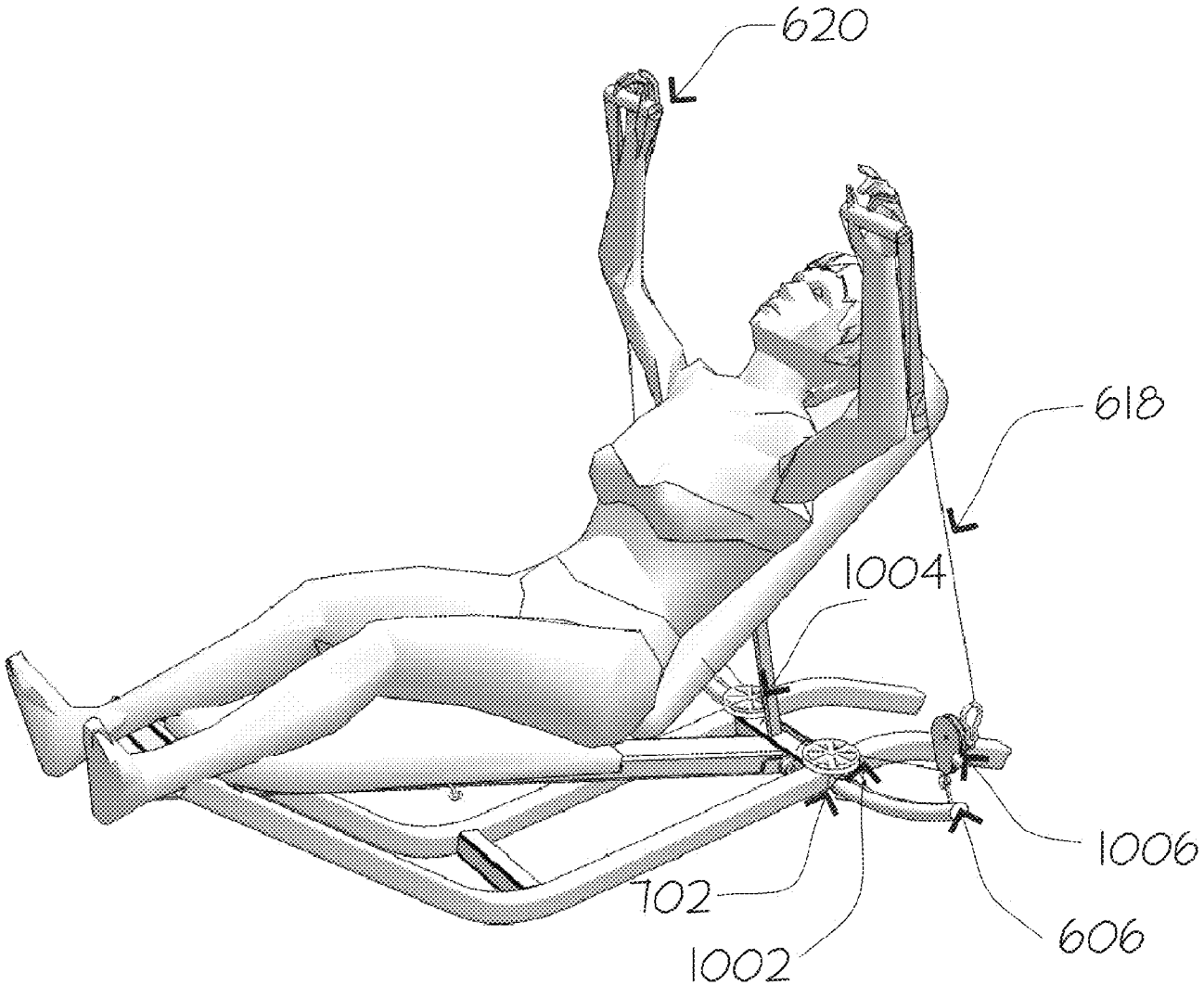
FIG. 10 is a perspective view of a rockable exercise apparatus with arm, handle, and pulley features in accordance with an exemplary embodiment of the present invention.

The cables 618, 620 each have a handle 626, 628, respectively, attached at an end thereof. The handles 626, 628 can be held by a user, as shown in FIG. 10, and, in conjunction with the resistance device 800, simulate the free weight exercise being performed by the user 522 in FIG. 5. More specifically, for the handles 626, 628 to be moved away from the respective ends 606, 614 of the respective arms 602, 610, the resistance of the elastic bands 802*a-n* must be overcome. It should be noted that the elastic bands 802*a-n* of the resistance device 800 are just one example of a resistance application device and that many other methods, techniques, and devices can be utilized to achieve the same result without departing from the spirit and scope of the present invention. One specific example of an additional embodiment could be to attach a length of rubber or other elastic material to the distal end of the arms 606 and 614. The bands can be stretched during exercises, thereby providing therapeutic resistance against the user's movements, similar to the cable system previously described.

Figure 7:
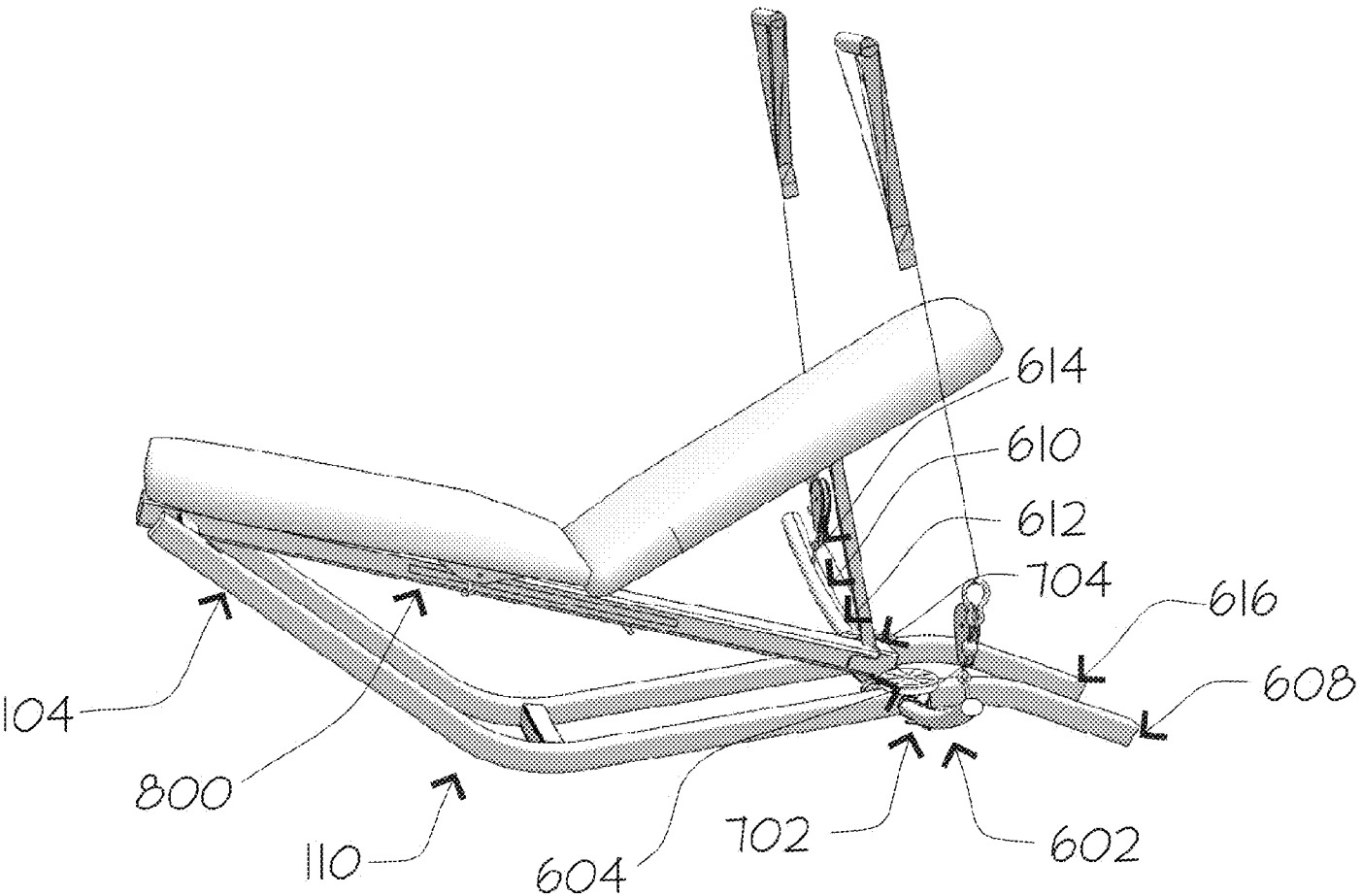
FIG. 7 is a perspective view of the rockable exercise apparatus of FIG. 6 with a portion of the upper surface secured in an elevated position.

For ease of storage and transportation, the present invention, according to one embodiment, shown in FIG. 7, has a first pivot point 702 at a junction between the first end 604 of the first arm 602 and the first side 608 of the support structure 104 and a second pivot 704 point at a junction between the first end 612 of the second arm 610 and the second side 616 of the support structure 104. The pivot points 702, 704 allow the arms 602, 610 to fold flat against the support structure 104. One further comment regarding the view of FIG. 7, the support structure curve 110 and support-structure end 114 together form a general "S" shape when viewed from a side thereof.

FIG. 10 shows yet another embodiment of the present invention, where a first pulley 1002 is provided at the first pivot point 702 and a second pulley 1004 is provided at the second pivot point 704 (not shown). The first pulley 1002 rotationally engages with the first cable 618 and the second pulley 1004 rotationally engages the second cable 620. The pulleys advantageously provide a smooth motion to the cables as they are used to exert force on the resistance device 800.

Similarly, a second set of pulleys 1006, 1008 are shown in FIGS. 9 and 10. The first 1006 of the second set of pulleys is attached at the second end 606 of the first arm 602 and the second 1008 of the second set of pulleys is attached at the second end 614 of the second arm 610. The second set of pulleys provides further smoothing of the motion of the cables.

Figure 11:
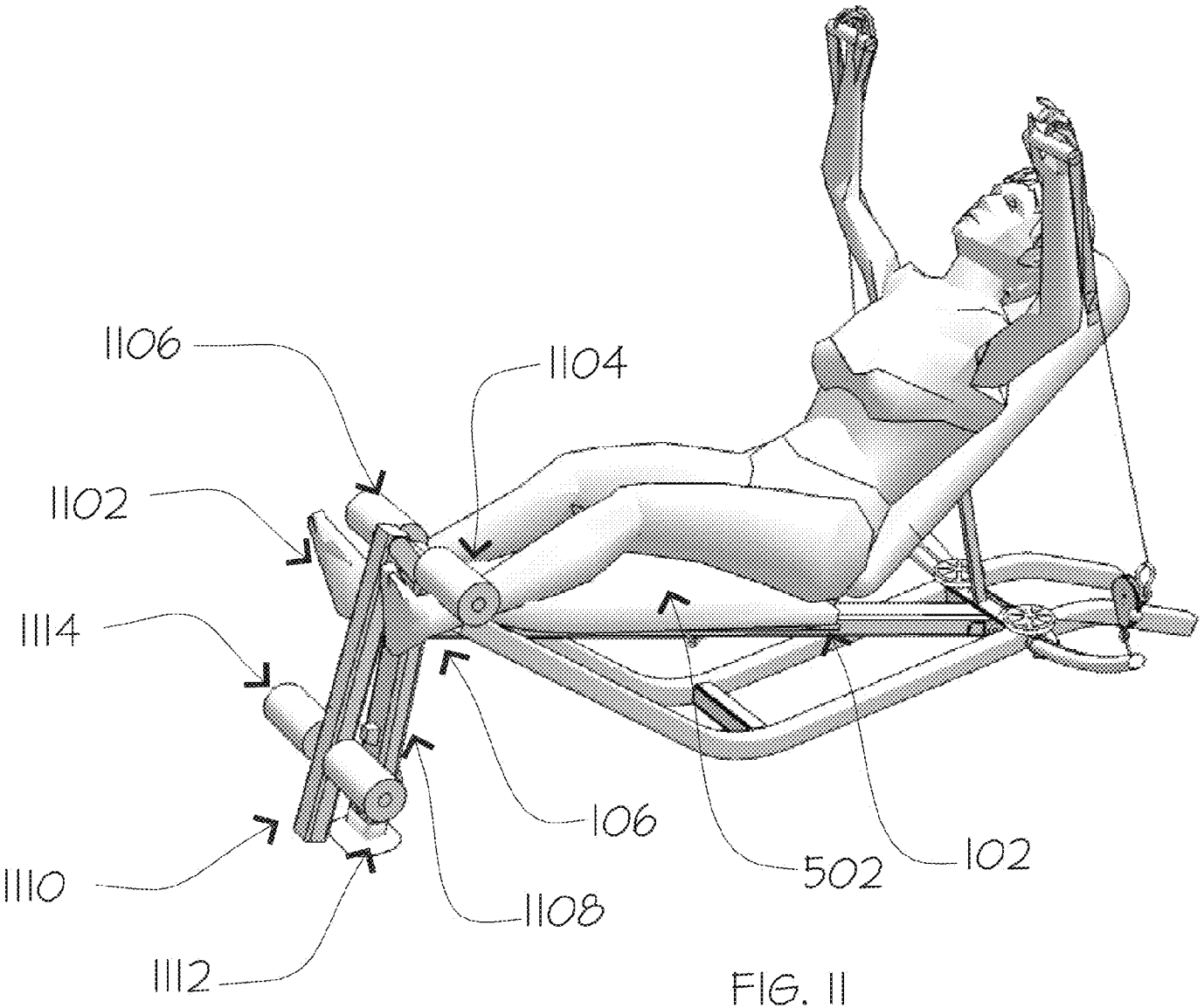
FIG. 11 is a perspective view of the rockable exercise apparatus of FIG. 10 with a leg exercise device in accordance with an exemplary embodiment of the present invention.
Figure 12:
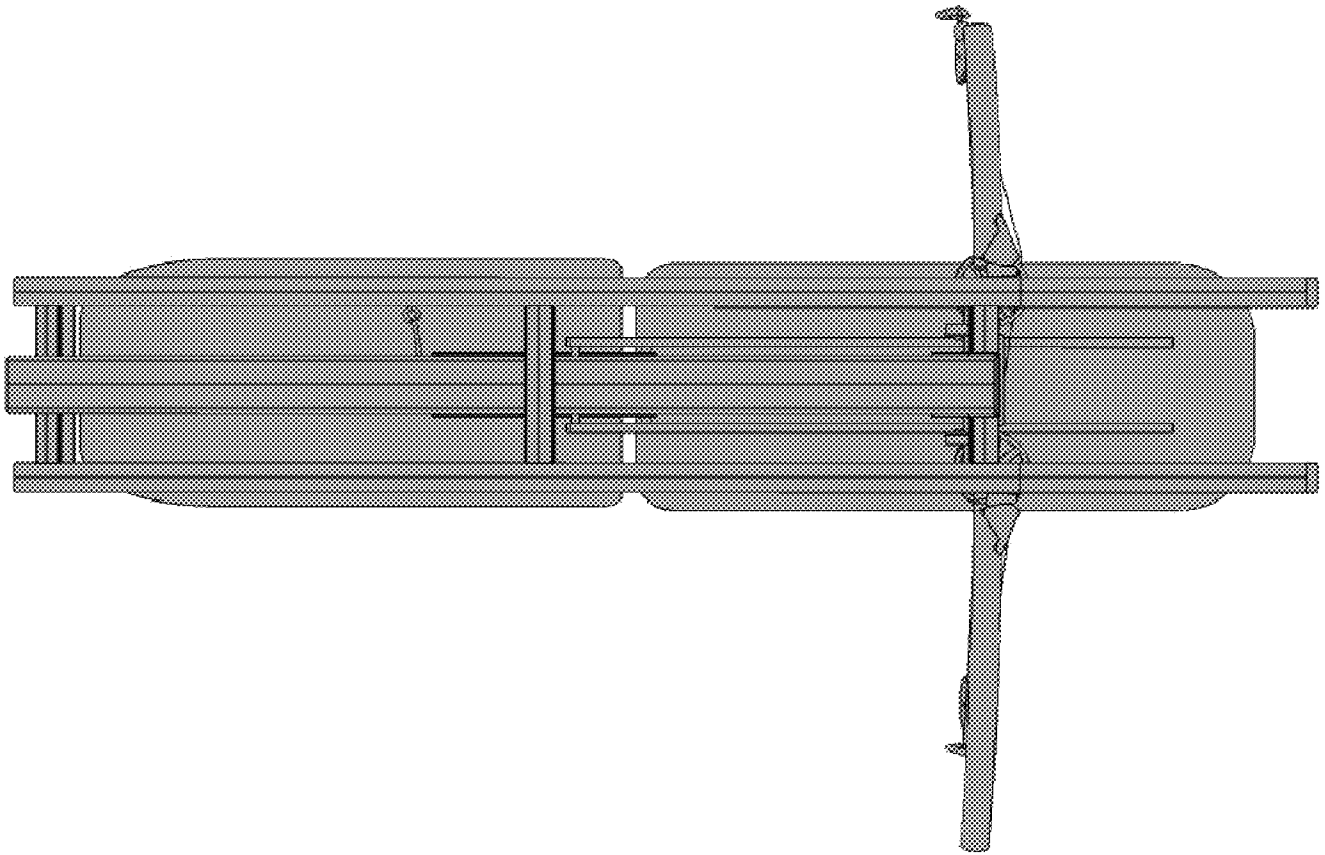
FIG. 12 is an elevational view of the underside of the rockable exercise apparatus of FIG. 7.
Figure 13:
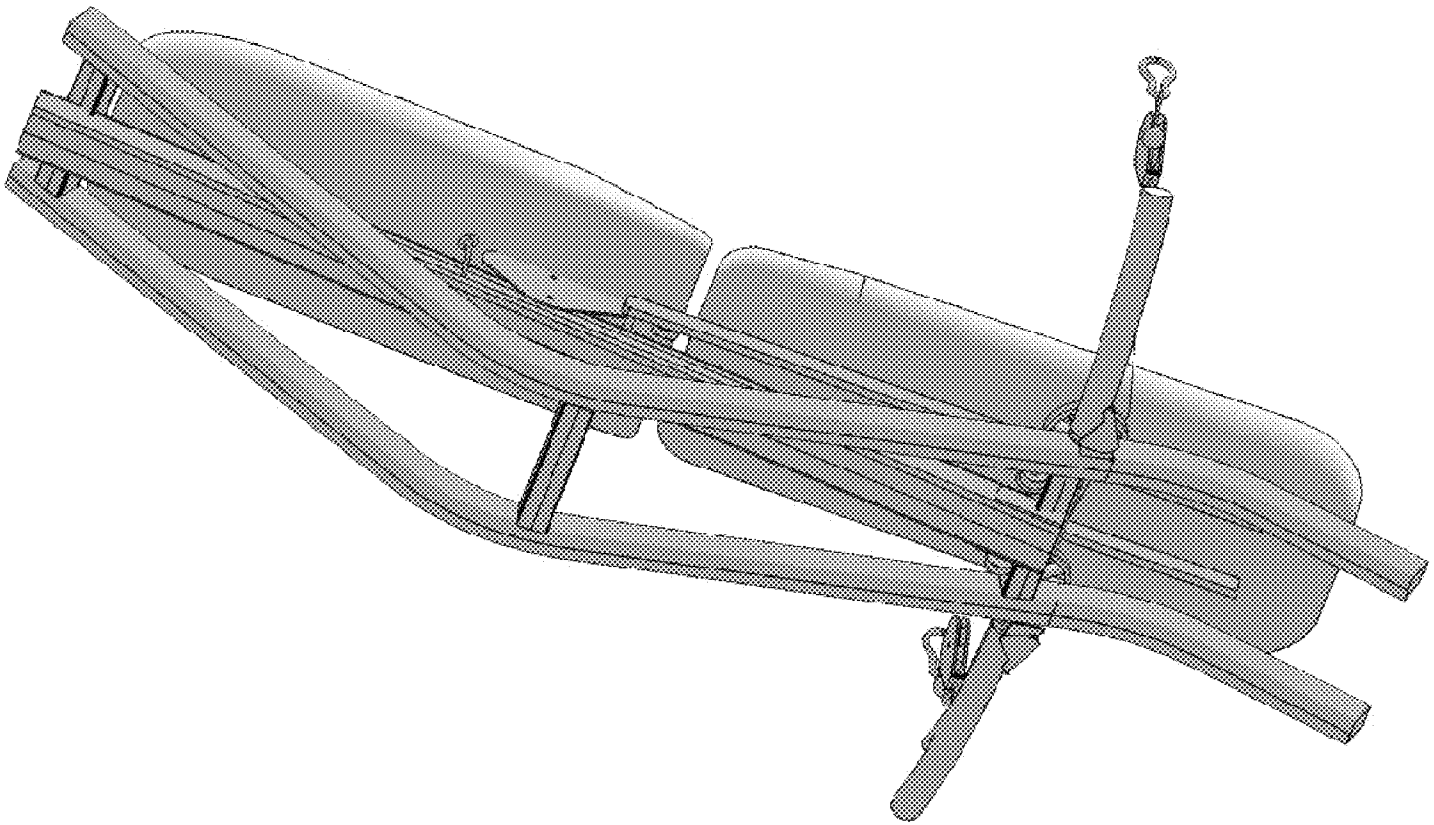
FIG. 13 is a perspective view of the underside of the rockable exercise apparatus of FIG. 7.

FIG. 11 shows additional features of the present invention, which includes a leg-securing structure 1102 at the first end 106 of the upper surface 102. The leg-securing structure 1102 has a first end 1104 and a second end 1106 opposite the first end 1104, the first 1104 and second 1106 extents being collinear and extending along an axis relatively parallel to an imaginary plane of the first portion 502 of the upper surface 102. The inventive device also includes a detachable support 1108 that is coupled at the first extent 106 of the first portion 502 of the upper surface 102, which coupling also includes securing the support 1108 directly to the support structure 104, and extends in a direction substantially perpendicular to imaginary plane of the first portion 502 of the upper surface 102. The present invention further includes an ankle-securing structure 1110 that is coupled to the support 1108. The ankle-securing structure 1110 has a first extent 1112 and a second extent 1114 opposite the first extent 1112, the first 1112 and second 1114 extents being collinear and extending along an axis relatively parallel to the axis of the first and second extents 1104, 1106 and relatively parallal to the imaginary plane of the first portion 502 of the upper surface 102. In one embodiment of the present invention, the ankle-securing structure 1110 pivots near the first extent 106 of the upper surface 102 and allows weights to be added thereto or, alternatively, is coupleable to the resistance device 800 (not shown). Movement of the ankle-securing structure 1110, which is resisted by weights or the resistance device 800 provides a valuable workout for the legs of a user.

In at least one embodiment of the present invention, a raising and lowering feature is provided. The raising and lower feature can be, for instance, a shock-type device that features a spring force to push the device upward and can be compressed once the user applies his or her weight onto the upper surface 102 of the device 100. The raising and lowering feature would reduce the distance that a user would have to lower themselves before making contact with the upper surface 102, making it somewhat easier to mount the device. If the raising and lower feature provided a positive lifting force, it would be easier for the user to remove themselves from the device as well, because they would be somewhat assisted in their transition from the sitting or laying position to the standing position. There are many ways to achieve the raising and lower feature and the present invention is in no way limited to the described shock-type embodiment. Any known or later developed method of causing the entire device 100, just the upper surface 102, or any portion of the device 100 to increase its distance from the floor is within the scope of the invention.

In a further embodiment, the upper surface 102 is slidable in relation to the lower support structure 104. Specifically, the entire upper surface 102 can slide in one or both directions from the vertex 112. This sliding feature can easily shift the user's weight in relation to the vertex 112, which will result in a corresponding change in the difficulty of exercises performed on the machine. In other embodiments, one or both of the two portions 106, 108 of the upper surface 102 can be slid independently in relation to the lower support structure 104. This is advantageous, for instance, in the event a taller user wishes to perform exercises with the device and desires the supporting surface are to extend beyond the configuration shown in FIG. 1, for example.

It should be noted that the present invention is not limited to use on a horizontal floor surface. In some embodiments, the invention can be used against a vertical wall or on even on an inclined surface. In addition, elements can be added that prevent the device from pivoting on the vertex 112. These elements include kickstand type linear elements that are attached to the lower support structure 104 and can be made to extend toward the surface upon which the device is supported. Other embodiments that achieve stability can be used as well.

An exercise apparatus has been disclosed that features a curved surface on a lower portion thereof, the curved surface allowing the apparatus to rock back and forth and provides a large range of exercises in a single unitary device. Other features of the invention have also been disclosed that add further versatility to the apparatus but are not necessary and are not intended to be limited to the particular details disclosed herein.

What is claimed is:

1. An exercise device for supporting the weight of a human torso comprising: a substantially planar upper surface having a first end and a second end; and a support structure fixedly coupled to the upper surface and supporting and spacing the upper surface from a floor, the support structure having: a curve with a vertex located at a fixed position between the first end and the second end; and a support-structure portion extending beyond the second end in a direction away from the first end, wherein the first end of the upper surface rests directly on a first end of the curve and the second end of the upper surface rests directly on a second end of the curve.

2. The exercise device according to claim 1, wherein the upper surface comprises:

a first portion including the first end; and a second portion including the second end and pivotally coupled to the first portion at a pivot point, wherein the first end and the second end pivot with respect to each other.

3. The exercise device according to claim 2, wherein the second, portion has a bottom side, and further comprising:

a support bar having a first end rotatably attached to the support structure and a second end removably attachable to any of a plurality of locations along the bottom side, thereby providing a plurality of second portion elevation angles.

4. The exercise device according to claim 3, wherein:

the vertex is located between a first plane and a second plane, the first plane passing through the first extent of the upper surface, the second plane passing through the pivot point, and the first and second planes being parallel to each other and perpendicular to the first portion of the upper surface.

5. The exercise device according to claim 2, wherein the first portion of the upper surface defines an upper-surface plane and further comprising:

a leg-securing structure coupled to the first portion of the upper surface, the leg-securing structure having a first leg extent and a second leg extent opposite the first leg extent, the first and second leg extents being collinear and extending in a plane parallel to the upper-surface plane.

6. The leg-securing structure according to claim 5, further comprising:

a detachable support coupled to the first portion of the upper surface and extending in a direction substantially perpendicular to the upper-surface plane.

7. The leg-securing structure according to claim 6, further comprising:

an ankle-securing structure coupled to the first portion of the upper surface, the ankle-securing structure having a first extent and a second extent opposite the first extent, the first and second extents being collinear and extending in a plane parallel to of the upper-surface plane.

8. The exercise device according to claim 1, wherein:

the support structure curve and support-structure portion extent together form a general "S" shape when viewed from a side thereof.

9. The exercise device according to claim 1, wherein the support structure has a first side and a second side opposite the first side, and further comprising:

a first arm having a first end coupled to the first side and a second end;

a second arm having a first end coupled to the second side and a second end;

a resistance device physically coupled to the support structure;

a first cable physically coupled to the resistance device and slidably engaged at the second end of the first arm; and a second cable physically coupled to the resistance device and slidably engaged at the second end of the second arm.

10. The exercise device according to claim 9, further comprising:

a first pivot point between the .first end of the first arm and the first side of the support structure; and a second pivot point between the first end of the second arm and the second side of the support structure.

11. The exercise device according to claim 10, further comprising:

a first pulley at the first pivot point; and a second pulley at the second pivot point, wherein the first pulley rotationally engages the first cable and the second pulley rotationally engages the second cable.

12. The exercise device according to claim 11, wherein:

the resistance device provides a selectable tension strength.

13. The exercise device according to claim 1, wherein:

the curve has a thickness so that the vertex has at least two points separated by a distance and a first line intersecting the at least two points is parallel to the upper surface and perpendicular to a second line intersecting the first end and second end of the upper surface.

14. An exercise device comprising:

a padded substantially planar upper support surface being at least four feet in length, having a first portion including the first end, and having a second portion that includes the second end and is pivotally coupled to the first portion at a pivot point; and a lower support structure:

coupled to the upper support surface;

having a length greater than a length of the upper support surface; and having a raised area located below and directed away from the upper support surface, thereby providing a rockable pivot point.

15. The exercise device according to claim 14, wherein: the upper surface includes a first end and a second end; and the raised area of the lower support structure is located between the first end and the second end.

16. The exercise device according to claim 14, wherein:

the lower support structure includes a curve shape; and the raised area of the lower support structure is a vertex of the curve shape.

17. An exercised device comprising:

an entirely planar upper surface having a first end, a second end, an underside, a first portion including the first end, and a second portion including the second end and pivotally coupled to the first portion at a pivot point; and a lower supporting frame:

having a first curved frame portion with a shape and a length, the first curved frame portion coupled to the underside of the planar upper surface, the length exceeding a distance between the first and second ends of the planar upper surface, and the shape having an apex directed away from the underside of the planar upper surface; and having a second curved frame portion with the shape coupled to the underside of the planar upper surface and to the first curved frame portion and spaced away from the first curved frame portion by a distance.

18. The exercise device according to claim 17, wherein:

the length of the first curved frame portion includes an extension that extends beyond the second end of the planar upper surface in a direction away from the first end.

* * * * *